US010227977B2

(12) United States Patent
Imamura

(10) Patent No.: US 10,227,977 B2
(45) Date of Patent: Mar. 12, 2019

(54) LIQUID DELIVERY PUMP

(71) Applicant: SHIMADZU CORPORATION, Kyoto-shi, Kyoto (JP)

(72) Inventor: Shinya Imamura, Ibaraki (JP)

(73) Assignee: SHIMADZU CORPORATION, Kyoto-shi (JP)

( * ) Notice: Subject to any disclaimer, the term of this patent is extended or adjusted under 35 U.S.C. 154(b) by 182 days.

(21) Appl. No.: 15/180,618

(22) Filed: Jun. 13, 2016

(65) Prior Publication Data

US 2016/0369793 A1 Dec. 22, 2016

(30) Foreign Application Priority Data

Jun. 18, 2015 (JP) ..... 2015-122692

(51) Int. Cl.

| | |
|---|---|
| ***F04B 53/04*** | (2006.01) |
| ***F04B 53/16*** | (2006.01) |
| ***F04B 53/00*** | (2006.01) |
| ***F04B 53/02*** | (2006.01) |
| ***F04B 53/14*** | (2006.01) |
| *F04B 9/02* | (2006.01) |

(52) U.S. Cl.

CPC ..... *F04B 53/162* (2013.01); *F04B 53/007* (2013.01); *F04B 53/02* (2013.01); *F04B 53/146* (2013.01); *F04B 53/164* (2013.01); *F04B 9/02* (2013.01)

(58) Field of Classification Search

CPC ..... F04B 53/162; F04B 53/164; F04B 53/02; F15B 15/1452; F15B 15/1471

See application file for complete search history.

(56) References Cited

U.S. PATENT DOCUMENTS

| | | | | |
|---|---|---|---|---|
| 1,317,294 A * | 9/1919 | Hildebrand | F16J 15/28 | 277/548 |
| 3,785,659 A * | 1/1974 | Maurer | F04B 53/164 | 277/500 |
| 4,494,760 A * | 1/1985 | Spargo | B63H 23/321 | 277/580 |
| 5,129,790 A * | 7/1992 | Ohnuma | F04B 53/164 | 417/63 |
| 5,655,885 A * | 8/1997 | Chung | F04B 5/02 | 417/360 |

(Continued)

OTHER PUBLICATIONS

Office Action dated Aug. 21, 2018, issued in counterpart Japanese Application No. 2015-122692, with English translation (6 pages).

*Primary Examiner* — Charles G Freay

(74) *Attorney, Agent, or Firm* — Westerman, Hattori, Daniels & Adrian, LLP

(57) ABSTRACT

A plunger seal is mounted on the pump head, has a through hole for allowing penetration of the plunger, and holds the outer circumferential surface of the plunger and also seals an opening of the pump chamber. A backup ring is mounted on the pump head by being interposed between the plunger seal and the tip end surface of the pump body. The backup ring has a through hole, for allowing penetration of the plunger, formed in a manner not allowing the plunger seal to enter a gap to the outer circumferential surface of the plunger, and also has a liquid passage element for allowing the cleaning liquid in the cleaning space to reach the plunger seal through the through hole.

7 Claims, 4 Drawing Sheets

(56) References Cited

U.S. PATENT DOCUMENTS

| | | | | |
|---|---|---|---|---|
| 5,887,507 | A * | 3/1999 | Kaito | F04B 9/042 417/470 |
| 9,194,391 | B2 | 11/2015 | Aso | |
| 2006/0140778 | A1* | 6/2006 | Warren | F04B 53/08 417/53 |
| 2009/0114086 | A1* | 5/2009 | Feraille | F04B 53/164 92/168 |
| 2011/0164996 | A1* | 7/2011 | Imamura | F04B 13/00 417/366 |
| 2012/0031264 | A1* | 2/2012 | Aso | F04B 53/162 92/88 |

* cited by examiner

LIQUID DELIVERY PUMP

BACKGROUND OF THE INVENTION

1. Field of the Invention

The present invention relates to a plunger-type liquid delivery pump for delivering liquid by sliding the tip end of a plunger inside a pump chamber provided in a pump head and repeating suction of liquid from a suction port and discharge of the liquid from a discharge port.

2. Description of the Related Art

A plunger-type liquid delivery pump slides a tip end portion of a plunger inside a pump chamber by mounting a pump head including the pump chamber inside to a tip end portion of a pump body and by causing a crosshead holding a base end of the plunger to reciprocate in the axial direction of the plunger inside the pump body.

The pump head is provided with an inlet channel for allowing liquid to flow into the pump chamber and an outlet channel for allowing the liquid to flow out of the pump chamber, A check valve is provided to each of the inlet channel and the outlet channel. According to such a structure, when the plunger is driven in the direction of being pulled out from the pump chamber (hereinafter referred to as a suction direction), the pressure inside the pump chamber is reduced, causing the check valve on the inlet channel side to open and the check valve on the outlet channel side to close, and liquid is suctioned into the pump chamber (suction operation). On the other hand, when the plunger is driven in the direction of being pushed into the pump chamber (hereinafter referred to as a discharge direction), the pressure inside the pump chamber is increased, causing the check valve on the inlet channel side to close and the check valve on the outlet channel side to open, and liquid inside the pump chamber is discharged through the outlet channel (discharge operation). Liquid delivery is performed by continuously performing such suction operation and discharge operation.

A plunger seal for preventing liquid leakage from the pump chamber is mounted on the pump head. The plunger seal is, a ring-shaped elastic member having a through hole allowing penetration of the plunger and is for sealing an opening of the pump chamber through which the plunger is inserted while allowing the plunger to slide inside the through hole.

The plunger seal is supported by a tip end surface of the pump body in such a way that the plunger seal is pressed toward the pump chamber side. A hole is provided to the tip end surface of the pump body so as to guide the tip end portion of the plunger to the pump head side. However, when the pressure inside the pump chamber becomes high, there is a problem that the plunger seal is deformed by the pressure, causing a part of the plunger seal to enter between the inner circumferential surface of the hole of the tip end surface of the pump body and the outer circumferential surface of the plunger, and thereby interfering with driving of the plunger and also accelerating deterioration of the plunger seal.

To cope with the problem described above, it is conceivable to reduce the inner diameter of the hole of the tip end surface of the pump body so as to reduce the gap to the plunger. The outer circumferential surface of the plunger is held by the plunger seal mounted on the pump head side, and the plunger reciprocates while sliding on the inner circumferential surface of the plunger seal, and thus, the track of the axis, at the time of operation of the plunger is determined by the positional relationship to the plunger seal. However, due to the assembly tolerance or the like of the pump head and the pump body, the positional relationship between the hole of the tip end surface of the pump body and the plunger seal is not always the same, and there is a problem that, if the inner diameter of the hole of the tip end surface of the pump body is made too small, the inner circumferential surface of the hole contacts the outer circumferential surface of the plunger, and damages to the plunger and the like may occur.

Because of such a problem, a backup ring is generally mounted on the back surface side of the plunger seal of the pump head (see U.S. Pat. No. 9,194,391B2). Since the backup ring is mounted on the pump head side, the positional relationship between a through hole provided to the backup ring and the through hole of the plunger seal is not affected by the assembly tolerance of the pump head and the pump body, and the inner diameter of the through hole of the backup ring may be made smaller than the hole of the tip and surface of the pump body, and deformation of the plunger seal may thereby be suppressed.

SUMMARY OF THE INVENTION

With the plunger-type liquid delivery pump, to maintain the accuracy of liquid delivery flow rate over a long period of time, it is important to suppress deterioration of the plunger seal. Since the plunger seal is for preventing liquid leakage from the pump chamber, it has to be in close contact with the outer circumferential surface of the plunger to a certain degree, but it also has to have certain slidability to the plunger so as not to prevent operation of the plunger. If the slidability between the outer circumferential surface of the plunger and the inner circumferential surface of the plunger seal is reduced, the plunger seal is worn out, and there are problems of liquid leakage due to seal failure on the outer circumferential surface of the plunger, and acceleration in the deterioration of the plunger seal due to frictional heat.

Accordingly, the present invention has its object to improve the slidability between the outer circumferential surface of a plunger and the inner circumferential surface of a plunger seal, and to suppress deterioration of the plunger seal.

An embodiment of a liquid delivery pump according to the present invention includes a plunger, a plunger driving mechanism, a pump head, a pump body, a plunger seal, and a backup ring. The plunger driving mechanism is for causing the plunger to reciprocate along an axial direction. The pump head includes a pump chamber whose one end side is an opening through which a tip end portion of the plunger is inserted, an inlet channel for allowing liquid to flow into the pump chamber, and an outlet channel for allowing liquid to flow out of the pump chamber. The pump body accommodates the plunger driving mechanism on an inside, has a plunger passage hole on a tip end surface to allow the plunger to protrude to a tip end side, and a cleaning space for containing cleaning liquid at a position of penetration of the plunger on an inside on the tip end side. The pump head is mounted at a tip end portion of the pump body in such a way as to allow a tip end of the plunger protruding from the plunger passage hole to be inserted into the pump chamber. The plunger passage hole on the tip end surface of the pump body has an inner diameter of a size allowing the cleaning liquid in the cleaning space to flow out to the pump head side. The plunger seal, mounted on the pump head, has a through hole for allowing penetration of the plunger, the plunger seal being for holding an outer circumferential surface of the plunger and for sealing the opening of the pump chamber. The backup ring is mounted on the pump head by being interposed between the plunger seal and the tip end surface of the pump body. Furthermore, the backup ring has a through hole, for allowing penetration of the plunger, formed in a manner not allowing the plunger seal to enter a gap to the outer circumferential surface of the plunger, and includes a liquid passage element for allowing the cleaning liquid in the cleaning space to reach the plunger seal through the through hole.

According to the embodiment of the liquid delivery pump of the present invention, the cleaning space containing cleaning liquid is provided on the tip end side of the pump body, the plunger passage hole on the tip end surface of the pump body has an inner diameter of a size allowing the cleaning liquid in the cleaning space to flow out to the pump head side, and the backup ring has a through hole, for allowing penetration of the plunger, formed in a manner not allowing the plunger seal to enter a gap to the outer circumferential surface of the plunger and includes a liquid passage element for allowing the cleaning liquid in the cleaning space to reach the plunger seal through the through hole, and thus, the cleaning liquid in the cleaning space may be supplied to the plunger seal, and the slidability between the plunger and the plunger seal may be secured by using the cleaning liquid in the cleaning space. Wear and deterioration of the plunger seal may thereby be suppressed, and reduction in the liquid delivery accuracy may be suppressed.

Additionally, if the inner diameter of the plunger passage hole on the tip end surface of the pump body is reduced to prevent the plunger seal from entering the gap of the plunger passage hole, the backup ring becomes unnecessary, and the cleaning space can be brought closer to the plunger seal by the thickness of the backup ring and the cleaning liquid in the cleaning space can be easily supplied to the plunger seal. However, as described above, if the inner diameter of the plunger passage hole on the tip end surface of the pump body is reduced, the outer circumferential surface of the plunger may come into contact with the inner circumferential surface of the hole due to, for example, the influence of the assembly tolerance of the pump body and pump head. Such a problem is solved by mounting, on the pump head side, the backup ring for preventing deformation of the plunger seal. However, if the backup ring is inserted on the back surface side of the plunger seal, passing of the cleaning liquid may be interfered with by the smallness of the inner diameter of the backup ring, and it may become difficult to supply the cleaning liquid to the plunger seal.

The embodiment described above of the present invention aims to suppress wear and deterioration of the plunger by allowing cleaning liquid to be easily supplied to the plunger seal, with the backup ring inserted on the back surface side of the plunger seal.

BRIEF DESCRIPTION OF THE DRAWINGS

FIG. 3A is a cross-sectional diagram of a state where the backup ring is embedded in the liquid delivery pump, and FIG. 3B is a plan view of the backup ring;

DETAILED DESCRIPTION OF THE INVENTION

As a preferred embodiment of a liquid delivery pump according to the present invention, one may be cited that is provided with a recessed section about the same size or larger than a plunger passage hole and serving as a liquid passage element at a center portion of a surface, of a backup ring, on a pump body side, the recessed section being provided with a through hole at its center. According to such a structure, cleaning liquid flowing out of a cleaning space is stored at a position close to a plunger seal, and the cleaning liquid may be easily supplied to the plunger seal.

Also, a groove where the cleaning liquid from the cleaning space is to pass through may be provided, as a liquid passage element, on the inner circumferential surface of the through hole of the backup ring. According to such a structure, it is possible to supply the cleaning liquid to the plunger seal while preventing the plunger seal from entering the through hole of the backup ring.

Further, the through hole of the backup ring, serving as the liquid passage element, may have an inner diameter which is on the pump body side, about the same size or larger than the plunger passage hole, and its inner circumferential surface may be sloped in such a way that the inner diameter is reduced toward the plunger seal side. That is, if the through hole of the backup ring is tapered, the cleaning liquid flowing out of the cleaning space may be easily guided to the plunger seal.

Furthermore, a hydrophilic coating may be applied, as the liquid passage element, on the inner circumferential surface of the through hole of the backup ring. This allows the cleaning liquid to easily pass through the gap between the inner circumferential surface of the through hole and the outer circumferential surface of the plunger, and the cleaning liquid may be easily supplied to the plunger seal.

Figure 1:
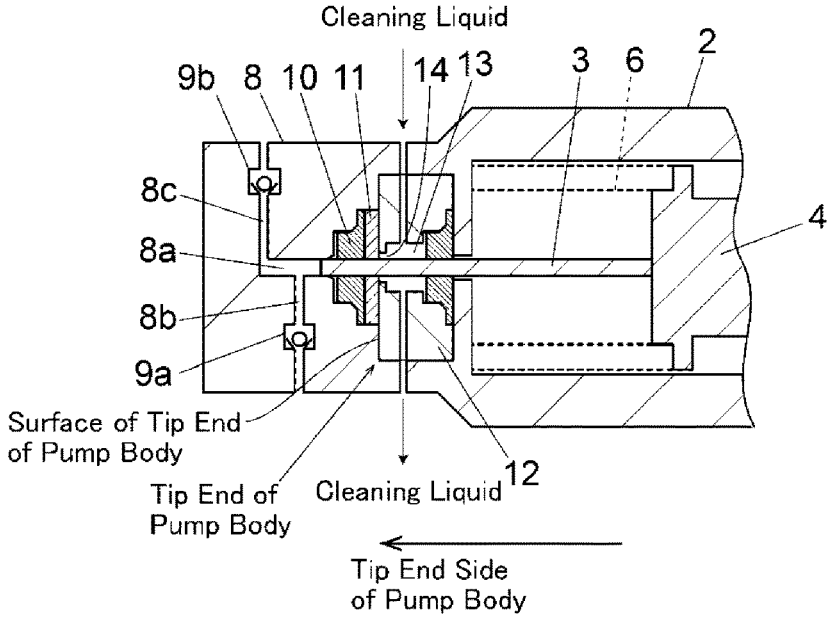
FIG. 1 is a cross-sectional diagram schematically showing an example of a liquid delivery pump.

An example of the liquid delivery pump will be described with reference to FIG. 1.

A pump head 8 is mounted at a tip end of a pump body 2. A cleaning chamber 12 is provided at a tip end portion of the pump body 2. A crosshead 4 is accommodated inside the pump body 2 in a manner capable of moving. The crosshead 4 is biased in a direction away from the pump head 8 (in the right direction in the drawing) by an elastic body 6, such as a spring, and follows the circumferential surface of a cam (not shown) provided on a base end portion side of the crosshead 4. The crosshead 4 thereby reciprocates along one direction (the left-right direction in the drawing) inside the pump body 2. As a mechanism for causing the crosshead 4 to reciprocate along one direction (a plunger driving mechanism), a linear motion mechanism using a lead screw or the like may be cited in addition to the cam mechanism.

A base end portion of a plunger 3 is held at a tip end of the crosshead 4. The tip end portion of the plunger 3 penetrates the cleaning chamber 12 and protrudes from the tip end surface of the pump body 2 toward the pump head 8, and is inserted in a pump chamber 8*a* provided inside the pump head 8. The tip end portion of the plunger 3 is made to slide along a wall surface of the pump chamber 8*a* by reciprocation of the crosshead 4.

An inlet channel 8*b* for allowing liquid to flow into the pump chamber 8*a*, and an outlet channel 8*c* for allowing the liquid to flow out of the pump chamber 8*a* are provided to the pump head 8. The inlet channel 8*b* and the outlet channel 8*c* are communicated with check valves 9*a*, 9*b*. In FIG. 1, the check valves 9*a* and 9*b* are shown inside the pump head 8, but they may be separately provided outside the pump head 8.

The pump chamber 8*a* has, on the surface of the pump head 8, on the pump body 2 side, an opening into which the tip end portion of the plunger 3 is to be inserted, and the opening is sealed by a plunger seal 10. The plunger seal 10 is a ring-shaped elastic member which has a through hole allowing the plunger 3 to penetrate, and which prevents liquid leakage from the pump chamber 8*a* while holding the outer circumferential surface of the plunger 3 by the inner circumferential surface of the through hole in a manner allowing the plunger 3 to slide. The plunger seal 10 is mounted on the pump head 8 by being fitted into a recessed section provided on the surface of the pump head 8, on the pump body 2 side.

A backup ring 11 is provided on the back surface side (the pump body 2 side) of the plunger seal 10. The backup ring 11 is a ring-shaped member that is interposed between the tip end surface of the pump body 2, that is, the surface of the cleaning chamber 12, on the pump head 8 side, and the plunger seal 10. The backup ring 11 is supported by the surface of the cleaning chamber 12, on the pump head 8 side (the tip end surface of the pump body 2). The backup ring 11 is made of polyether ether ketone (PEEK) resin or stainless steel, for example.

A cleaning space 13 is provided inside the cleaning chamber 12, and the plunger 3 penetrates the cleaning space 13. Cleaning liquid is to flow to the cleaning space 13 of the cleaning chamber 12, and the outer circumferential surface of the plunger 3 penetrating the cleaning space 13 is to be cleaned. A plunger passage hole 14 for allowing penetration of the plunger is provided on the surface of the cleaning chamber 12, on the pump head side (on the tip end surface of the pump body 2). The plunger passage hole 14 has an inner diameter allowing formation of a gap to the outer circumferential surface of the plunger 3, the gap having a size enough to allow the cleaning liquid flowing through the cleaning space 13 to flow out to the backup ring 11 side, such as about 0.1 mm.

The backup ring 11 is provided with a liquid passage element for guiding the cleaning liquid flowing out of the cleaning space 13 to the plunger seal 10 side. Details of the liquid passage element will be given later.

Operation of the liquid delivery pump of the present example will be described. When the plunger 3 is driven in the direction of being pulled out from the pump chamber 8*a* (in the right direction in the drawing), the pressure inside the pump chamber 8*a* is reduced, the check valve 9*b* is closed, causing the check valve 9*a* to open, and liquid is suctioned through the inlet channel 8*b*. On the other hand, when the plunger 3 is driven in the direction of being pushed into the pump chamber 8*a* (in the left direction in the drawing), the pressure inside the pump chamber 8*a* is increased, causing the check valve 9*a* to close and the check valve 9*b* to open, and the liquid is discharged from the pump chamber 8*a* through the outlet channel 8*c*, Liquid delivery is performed by continuously performing such suction operation and discharge operation.

Examples of the backup ring 11 including the liquid passage element are shown in FIGS. 2 to 6.

Figure 2:
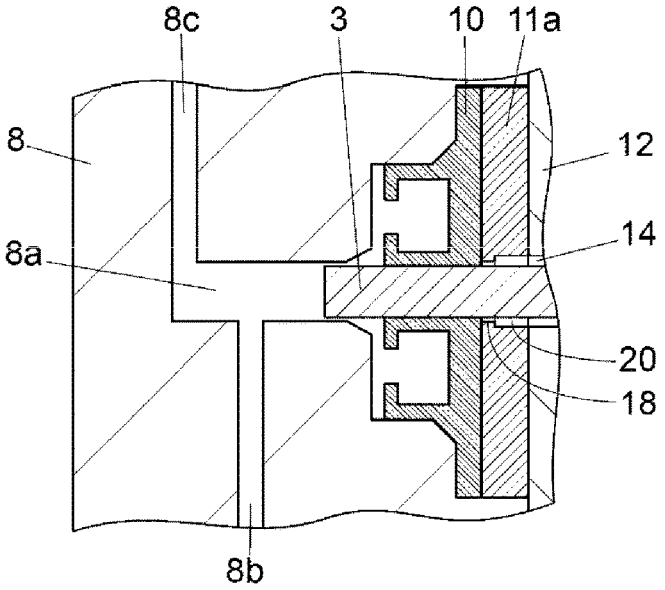
FIG. 2 is a cross-sectional diagram for describing an example of a liquid passage element of a backup ring, the diagram showing a state where the backup ring is embedded in the liquid delivery pump.

A backup ring 11*a* shown in FIG. 2 includes, at a center portion of the surface on the cleaning chamber 12 side, as a liquid passage element, a recessed section 20 about the same size as the plunger passage hole 14 of the cleaning chamber 12. A through hole 18 for allowing penetration of the plunger 3 is provided at a center portion of the bottom surface of the recessed section 20. Additionally, the inner diameter of the recessed section 20 may be greater than that of the plunger passage hole 14.

The through hole 18 has an inner diameter allowing formation of a gap between the inner circumferential surface of the through hole 18 and the outer circumferential surface of the plunger 3, the gap having a size not allowing entering of a part of the plunger seal 10, such as about 0.01 mm. The width of the through hole 18 (the length in the axial direction of the plunger 3) is desirably the minimum required to withstand the pressure from the plunger seal 10. The minimum width is about 1 mm in a case where the backup ring 11*a*, for example, is of PEEK resin, and is about 0.5 mm in a case where the backup ring 11*a* is of stainless steel.

According to such a structure, cleaning liquid flowing out of the cleaning space 13 through the gap of the plunger passage hole 14 is stored inside the recessed section 20 provided at a position next to the through hole 18, and the cleaning liquid may be easily supplied to the plunger seal 10 side through the through hole 18 having the minimum required width. Cleaning liquid supplied to the plunger seal 10 side enters between the outer circumferential surface of the plunger 3 and the inner circumferential surface of the plunger seal 10 to serve as a lubricating agent, the friction coefficient between the plunger 3 and the plunger seal 10 is reduced, and wear and deterioration of the plunger seal 10 are reduced.

Figure 3A:
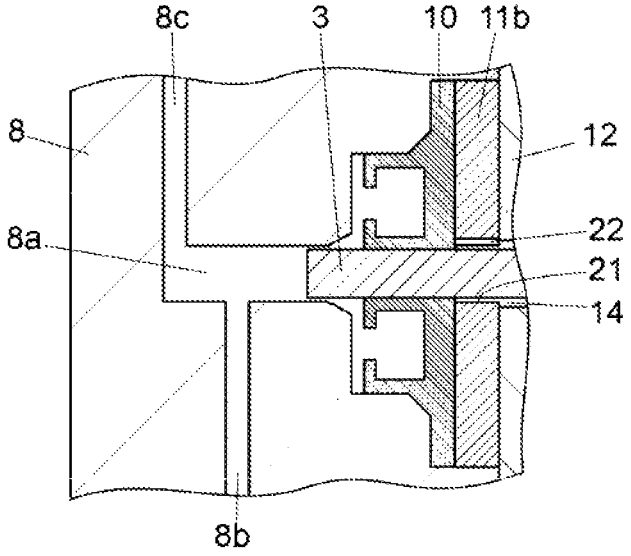
FIGS. 3A and 3B are diagrams showing another example of the liquid passage element.
Figure 3B:
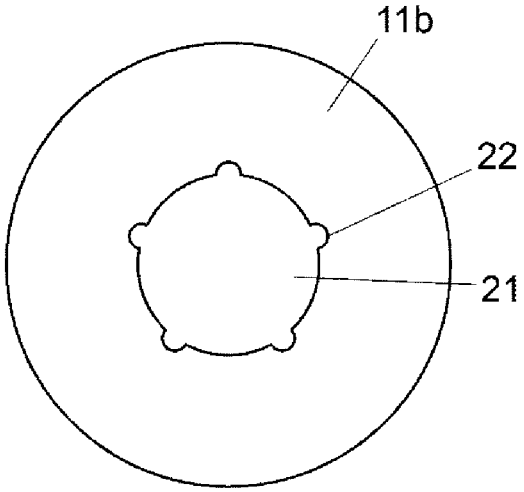

A backup ring 11*b* shown in FIGS. 3A and 3B has, at a center portion, a through hole 21 for allowing penetration of the plunger 3. The through hole 21 has an inner diameter allowing formation of a gap between the inner circumferential surface of the through hole 21 and the outer circumferential surface of the plunger 3, the gap having a size not allowing entering of a part of the plunger seal 10, such as about 0.01 mm. Grooves 22 serving as liquid passage elements are provided at a plurality of positions on the inner circumferential surface of the through hole 21, the grooves 22 extending from the surface of the backup ring 11*b*, on the cleaning chamber 12 side, to the surface on the plunger seal 10 side.

Because the grooves 22 are provided on the inner circumferential surface of the through hole 21, cleaning liquid flowing out through the gap of the plunger passage hole 14 is supplied to the plunger seal 10 through the grooves 22, the friction coefficient between the plunger 3 and the plunger seal 10 is reduced, and wear and deterioration of the plunger seal 10 are reduced.

Figure 4:
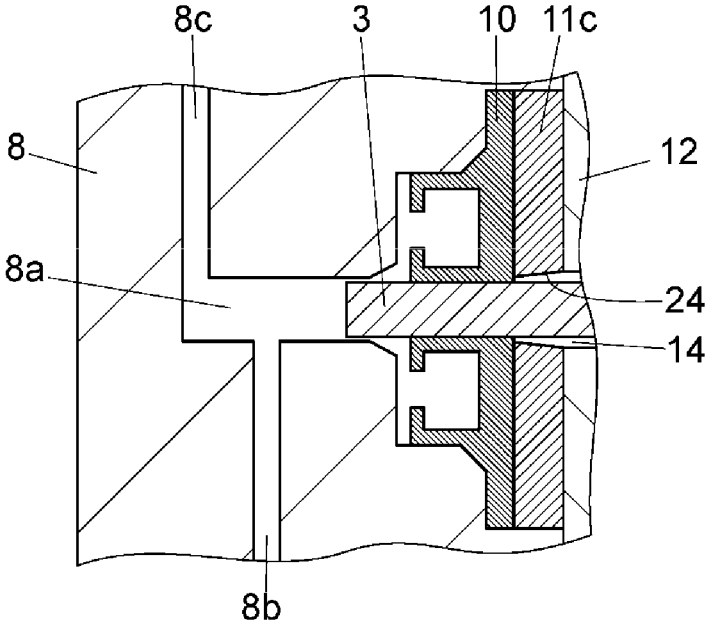
FIG. 4 is a cross-sectional diagram for describing further another example of the liquid passage element, the diagram showing a state where the backup ring is embedded in the liquid delivery pump.

According to a backup ring 11*c* shown in FIG. 4, the inner circumferential surface of a through hole 24, serving as a liquid passage element, for allowing penetration of the plunger 3 is sloped in such a way that the inner diameter is reduced from the cleaning chamber 12 side toward the plunger seal 10 side. The inner diameter of the through hole 24, on the cleaning chamber 12 side, is about the same size or larger than the inner diameter of the plunger passage hole 14. The inner diameter of the through hole 24, on the plunger seal 10 side, is a size allowing formation of a gap having a size not allowing entering of a part of the plunger seal 10, such as about 0.01 mm.

Because the through hole 24 is tapered with wide opening on the cleaning chamber 12 side, cleaning liquid flowing out through the gap of the plunger passage hole 14 may easily reach the plunger seal 10, the friction coefficient between the plunger 3 and the plunger seal 10 is reduced, and wear and deterioration of the plunger seal 10 are reduced.

Figure 5:
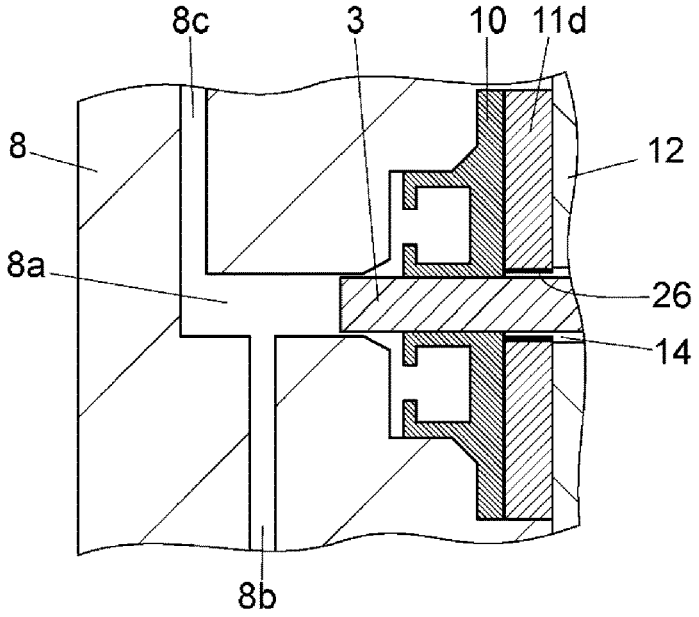
FIG. 5 is a cross-sectional diagram for describing still another example of the liquid passage element, the diagram showing a state where the backup ring is embedded in the liquid delivery pump.

According to a backup ring 11*d* shown in FIG. 5, a hydrophilic coating 26 is applied, as a liquid passage element on the inner circumferential surface of the through hole for allowing penetration of the plunger 3. As the hydrophilic coating 26, a hydrophilic polymer thin film applied or a titanium oxide thin film formed by a plasma CVD method may be cited.

The inner diameter of the through hole of the backup ring 11*d* is a size allowing formation of a gap having a size not allowing entering of a part of the plunger seal 10, such as about 0.01 mm, but since the hydrophilic coating 26 is applied on the inner circumferential surface, cleaning liquid may be easily guided to the plunger seal 10 side, the friction coefficient between the plunger 3 and the plunger seal 10 is reduced, and wear and deterioration of the plunger seal 10 are reduced.

Figure 6:
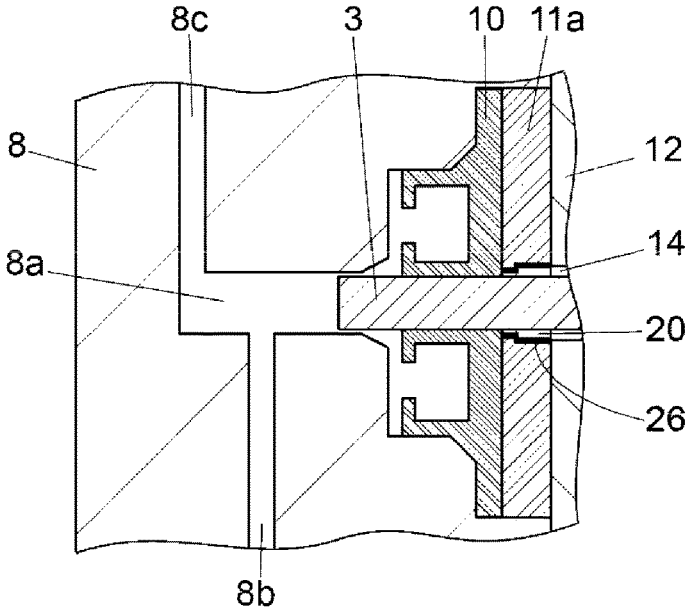
FIG. 6 is a cross-sectional diagram for describing still another example of the liquid passage element, the diagram showing a state where the backup ring is embedded in the liquid delivery pump.

Additionally, the hydrophilic coating 26 may applied on the inner circumferential surfaces of the through holes of the backup rings 11*a* to 11*c* shown in FIGS. 2 to 4. FIG. 6 shows an example where the hydrophilic coating 26 is applied on the inner circumferential surfaces of the through hole 18 and the recessed section 20 of the backup ring 11*a* in FIG. 2. By applying the hydrophilic coating 26 on the inner circumferential surfaces of the through hole 18 and the recessed section 20, supply of cleaning liquid to the plunger seal 10 is further promoted, and the effect of suppressing wear and deterioration of the plunger seal 10 is increased.

What is claimed is:

1. A liquid delivery pump comprising:

a plunger;

a plunger driving mechanism for causing the plunger to reciprocate along an axial direction;

a pump head including a pump chamber having an end side that is an opening through which a portion of a tip end of the plunger is inserted, an inlet channel for allowing liquid to flow into the pump chamber, and an outlet channel for allowing liquid to flow out of the pump chamber;

a pump body accommodating the plunger driving mechanism on an inside thereof, having a plunger passage hole on a surface of a tip end side of the pump body to allow the plunger to protrude to the tip end side of the pump body, and a cleaning space for containing cleaning liquid at a position of penetration of the plunger on an inside on the tip end side of the pump body, and having the pump head mounted at the tip end side of the pump body in such a way as to allow the tip end of the plunger protruding from the plunger passage hole to be inserted into the pump chamber, the plunger passage hole having an inner diameter of a size allowing the cleaning liquid in the cleaning space to flow out to the tip end side of the pump body;

a plunger seal having a ring shape, mounted on the pump head, the plunger seal being for holding an outer circumferential surface of the plunger and for sealing the opening of the pump chamber; and a backup ring, mounted on the pump head by being interposed between the plunger seal and the pump body and having a through hole (i) for allowing penetration of the plunger, (ii) formed in a manner not allowing the plunger seal to enter a gap to the outer circumferential surface of the plunger, and (iii) including a liquid passage element for allowing the cleaning liquid in the cleaning space to reach the plunger seal through the through hole, wherein the liquid passage element is a recessed section provided at a center portion of a surface of a pump body side of the back up ring, an inner diameter of the recessed section has the same size or larger than the plunger passage hole, and the through hole, of which inner diameter is smaller than that of the plunger passage hole, is provided at the center of the recessed section.

2. The liquid delivery pump according to claim 1, wherein a hydrophilic coating is applied on an inner circumferential surface of the through hole of the backup ring.

3. A liquid delivery pump comprising:

a plunger;

a plunger driving mechanism for causing the plunger to reciprocate along an axial direction;

a pump head including a pump chamber having an end side that is an opening through which a portion of a tip end of the plunger is inserted, an inlet channel for allowing liquid to flow into the pump chamber, and an outlet channel for allowing liquid to flow out of the pump chamber;

a pump body accommodating the plunger driving mechanism on an inside thereof, having a plunger passage hole on a surface of a tip end side of the pump body to allow the plunger to protrude to the tip end side of the pump body, and a cleaning space for containing cleaning liquid at a position of penetration of the plunger on an inside on the tip end side of the pump body, and having the pump head mounted at the tip end side of the pump body in such a way as to allow the tip end of the plunger protruding from the plunger passage hole to be inserted into the pump chamber, the plunger passage hole having an inner diameter of a size allowing the cleaning liquid in the cleaning space to flow out to the tip end side of the pump body;

a plunger seal having a ring shape, mounted on the pump head, the plunger seal being for holding an outer circumferential surface of the plunger and for sealing the opening of the pump chamber; and a backup ring, mounted on the pump head by being interposed between the plunger seal and the pump body and having a through hole (i) for allowing penetration of the plunger, (ii) formed in a manner not allowing the plunger seal to enter a gap to the outer circumferential surface of the plunger, and (iii) including a liquid passage element for allowing the cleaning liquid in the cleaning space to reach the plunger seal through the through hole, wherein the liquid passage element is a groove where the cleaning liquid from the cleaning space is to pass through, the groove is oriented in a direction essentially parallel to the axis of the plunger, and is provided on an inner circumferential surface of the through hole of the backup ring.

4. The liquid delivery pump according to claim 3, wherein a hydrophilic coating is applied on the inner circumferential surface.

5. A liquid delivery pump comprising:

a plunger;

a plunger driving mechanism for causing the plunger to reciprocate along an axial direction;

a pump head including a pump chamber having an end side that is an opening through which a portion of a tip end of the plunger is inserted, an inlet channel for allowing liquid to flow into the pump chamber, and an outlet channel for allowing liquid to flow out of the pump chamber;

a pump body accommodating the plunger driving mechanism on an inside thereof, having a plunger passage hole on a surface of a tip end side of the pump body to allow the plunger to protrude to the tip end side of the pump body, and a cleaning space for containing cleaning liquid at a position of penetration of the plunger on an inside on the tip end side of the pump body, and having the pump head mounted at the tip end side of the pump body in such a way as to allow the tip end of the plunger protruding from the plunger passage hole to be inserted into the pump chamber, the plunger passage hole having an inner diameter of a size allowing the cleaning liquid in the cleaning space to flow out to the tip end side of the pump body;

a plunger seal having a ring shape, mounted on the pump head, the plunger seal being for holding an outer circumferential surface of the plunger and for sealing the opening of the pump chamber; and a backup ring, mounted on the pump head by being interposed between the plunger seal and the pump body and having a through hole (i) for allowing penetration of the plunger, (ii) formed in a manner not allowing the plunger seal to enter a gap to the outer circumferential surface of the plunger, and (iii) including a liquid passage element for allowing the cleaning liquid in the cleaning space to reach the plunger seal through the through hole, wherein the through hole, of the backup ring, serving as the liquid passage element, has an inner diameter that is, on the pump body side, the same size or larger than the plunger passage hole, and its inner circumferential surface is sloped in such a way that the inner diameter is reduced toward the plunger seal side.

6. The liquid delivery pump according to claim 5, wherein a hydrophilic coating is applied on the inner circumferential surface.

7. A liquid delivery pump comprising:

a plunger;

a plunger driving mechanism for causing the plunger to reciprocate along an axial direction;

a pump head including a pump chamber having an end side that is an opening through which a portion of a tip end of the plunger is inserted, an inlet channel for allowing liquid to flow into the pump chamber, and an outlet channel for allowing liquid to flow out of the pump chamber;

a pump body accommodating the plunger driving mechanism on an inside thereof, having a plunger passage hole on a surface of a tip end side of the pump body to allow the plunger to protrude to the tip end side of the pump body, and a cleaning space for containing cleaning liquid at a position of penetration of the plunger on an inside on the tip end side of the pump body, and having the pump head mounted at the tip end side of the pump body in such a way as to allow the tip end of the plunger protruding from the plunger passage hole to be inserted into the pump chamber, the plunger passage hole having an inner diameter of a size allowing the cleaning liquid in the cleaning space to flow out to the tip end side of the pump body;

a plunger seal having a ring shape, mounted on the pump head, the plunger seal being for holding an outer circumferential surface of the plunger and for sealing the opening of the pump chamber; and a backup ring, mounted on the pump head by being interposed between the plunger seal and the pump body and having a through hole (i) for allowing penetration of the plunger, (ii) formed in a manner not allowing the plunger seal to enter a gap to the outer circumferential surface of the plunger, and (iii) including a liquid passage element for allowing the cleaning liquid in the cleaning space to reach the plunger seal through the through hole, wherein the liquid passage element is a hydrophilic coating applied on an inner circumferential surface of the through hole of the backup ring.

* * * * *